US005151883A

United States Patent [19]

Mitome

[11] Patent Number: 5,151,883

[45] Date of Patent: Sep. 29, 1992

[54] FLUID DRIVE METHOD USING ULTRASONIC WAVES

[75] Inventor: Hideto Mitome, Tsukuba, Japan

[73] Assignees: Agency of Industrial Science and Technology; Ministry of International Trade and Industry, both of Tokyo, Japan

[21] Appl. No.: 673,407

[22] Filed: Mar. 22, 1991

[30] Foreign Application Priority Data

Mar. 28, 1990 [JP] Japan ..... 2-79678

[51] Int. Cl.[5] ..... H04R 17/00

[52] U.S. Cl. ..... 367/138; 367/140; 367/191; 310/334; 55/277

[58] Field of Search ..... 367/140, 137, 138, 191; 55/15, 277; 310/334, 337

[56] References Cited

U.S. PATENT DOCUMENTS 4,316,734 2/1982 Spinosa et al. ..... 55/15
4,684,328 8/1987 Murphy ..... 417/322

OTHER PUBLICATIONS

Ultrasound in Med. & Biol., vol. 15, No. 4, "An Experimental Investigation of Streaming in Pulsed Diagnostic Ultrasound Beam" H. C. Starritt et al., pp. 363-373, 1989.

*Primary Examiner*—J. W. Eldred
*Attorney, Agent, or Firm*—Oblon, Spivak, McClelland, Maier & Neustadt

[57] ABSTRACT

A method of driving a fluid by transmitting ultrasonic waves in the fluid, in which electrical signals applied to a transducer in the fluid are controlled to change the amplitude and duty ratio of tone burst waves so as to control the distribution of the ultrasonic driving force in the fluid, and the driving force itself.

2 Claims, 3 Drawing Sheets

FLUID DRIVE METHOD USING ULTRASONIC WAVES

BACKGROUND OF THE INVENTION

1. Field of the Invention

The present invention relates to a method of driving a fluid by transmitting ultrasound in the fluid, and more particularly to a fluid drive method which facilitates the control of a driving force generated by ultrasound.

2. Description of the Prior Art

There is a phenomenon known as acoustic streaming, which refers to flow currents set up in a fluid that is generated with powerful ultrasonic waves. While former research into acoustic streaming has used continuous ultrasonic waves, recently the use of pulsed ultrasound to set up flow currents in a fluid has been reported (Ultrasound in Med. & Biol. Vol. 15, No. 4, pp. 363–373, 1989).

A possible application for acoustic streaming is to utilize it in devices that generate fluid flows, such as pumps and stirrers. For such an application, given the same driving force to the fluid, the smaller the ultrasonic energy the better, as it enables the apparatus to be made smaller and reduces energy costs. Moreover, the ability to control the generated flow current by controlling the driving force makes it possible to generate a flow in a limited region and, therefore, broadens the range of possible applications.

The object of the present invention is therefore to provide a method of driving a fluid by using ultrasonic waves wherein the intensity of the force used to drive the fluid can be readily controlled through ultrasound and the distribution of the fluid driving force can be adjusted.

SUMMARY OF THE INVENTION

In accordance with the present invention the above object is attained by a method of driving a fluid by transmitting ultrasonic waves in the fluid, comprising the regulation of electrical signals applied to a transducer disposed in the fluid to change the amplitude and duty ratio of tone burst waves emitted by the transducer so as to set the position at which the ultrasonic-based driving force acts on the fluid to a desired position and to control the driving force.

Given the same time-averaged sound energy density, the smaller the duty ratio of the tone burst waves the larger the driving force that is generated, in addition to which it is the fluid more local to the transducer that is driven. Therefore, by regulating the electrical signals being applied to the transducer to change the duty factor and/or amplitude of the tone burst waves, it becomes possible to generate driving force of a desired intensity distribution at a desired location in the fluid and intensity distribution and form a beam-shaped flow current in the fluid.

In this specification "tone burst wave" means an intermittent wave as opposed to a continuous ultrasonic wave.

Further features of the invention, its nature and various advantages will become more apparent from the accompanying drawings and following detailed description of the invention.

BRIEF DESCRIPTION OF THE DRAWINGS

FIG. 1(*b*) is a waveform of a tone burst wave;

FIG. 2(*b*) is the waveform of a tone burst wave with a duty ratio of 0.5;

FIG. 2(*c*) is the waveform of a tone burst wave with a duty ratio of 0.25;

DETAILED DESCRIPTION OF THE PREFERRED EMBODIMENTS

As explained above, ultrasonic transmission in a fluid induces acoustic streaming, i.e. flow currents in the fluid due to the sound waves. It was found that for the same time-averaged sound energy density, the smaller the duty ratio of the tone burst waves the larger the driving force that is generated and the more local it is to the transducer. The reason for this is as follows.

Figure 1A:
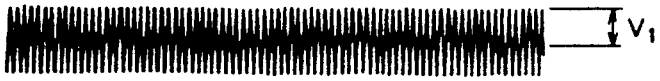
FIG. 1(*a*) is a waveform of a continuous sound wave.
Figure 1B:
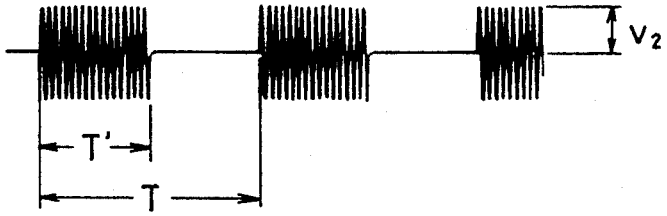

FIG. 1(*a*) is a waveform of a continuous sound wave of amplitude $v_1$ and FIG. 1(*b*) is a tone burst waveform where $v_2$ is the amplitude and T is the period of the burst cycle, with the transducer generating the wave motion for a time period T'.

For a plane sound wave, the time-averaged sound energy density w can be expressed by equation (1) as $$w=\rho A v^2/2 \tag{1}$$

where $\rho$ is the density of the fluid, A is the duty ratio of the sound wave defined as T'/T, v is the amplitude of particle velocity of the sound wave.

From equation (1), it can be seen that to obtain the same time-averaged sound energy density w using a sound wave with a different duty ratio A, the smaller the duty ratio A of the tone burst waves, the larger the amplitude v has to be. If the value of $Av^2$ is kept constant by regulating amplitude v according to the value of the duty ratio A, it becomes possible to generate a sound wave having the same time-averaged sound energy density w at the transducer.

Driving force of acoustic streaming F can be expressed by equation (2) as $$F=-(1/\rho)(dw/dx) \tag{2}$$

where w is the time-averaged sound energy density and x is the distance the sound wave propagates in the fluid medium.

From equation (2) it can be seen that (dw/dx) has a major influence on driving force F. This (dw/dx) is the spatial gradient of the time-averaged sound energy density and it is negative because of the attenuation accompanying propagation. It can therefore be seen that when −(dw/dx) becomes positive, the larger the attenuation, the larger the driving force of acoustic streaming F becomes.

Next, a 10-mm disk transducer of piezoelectric ceramics was immersed to emit ultrasound of 5.09 MHz into water to induce acoustic streaming. Sound waves were emitted with several values of the duty ratio A changing from 1 to 0.05, with the amplitude being changed from 1 to $\sqrt{20}$ to obtain the same time-averaged sound energy density at the transducer.

Figure 2A:
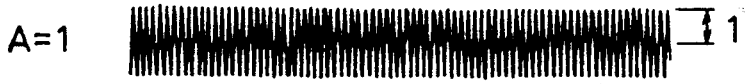
FIG. 2(*a*) is the waveform of a tone burst wave with a duty ratio of 1.
Figure 2B:
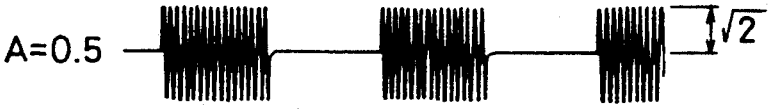
Figure 2C:
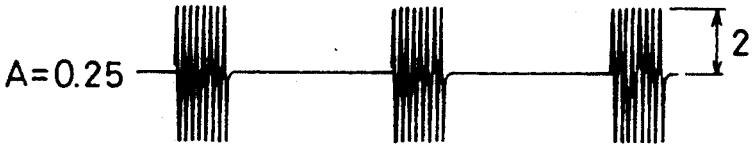

FIG. 2(*a*) shows the waveform of sound waves with a duty ratio A of 1, and FIG. 2(*b*) is the waveform when the duty ratio is 0.5 and FIG. 2(*c*) is the waveform when the duty ratio is 0.25. Taking the amplitude of the sound waves with a duty ratio of 1 as 1, for the duty ratio of 0.5 the amplitude was taken to be $\sqrt{2}$, and 2 in the case of the duty ratio of 0.25.

It was found from flow visualization experiments applying several kinds of electrical signals to the transducer in water while thus varying the duty ratio and amplitude to obtain the same time-averaged sound energy density value that high amplitude tone burst waves with a small duty ratio produced the stronger driving force and that the action of the driving force was more localized to the fluid near the transducer. The reason for this will now be explained.

Figure 3:
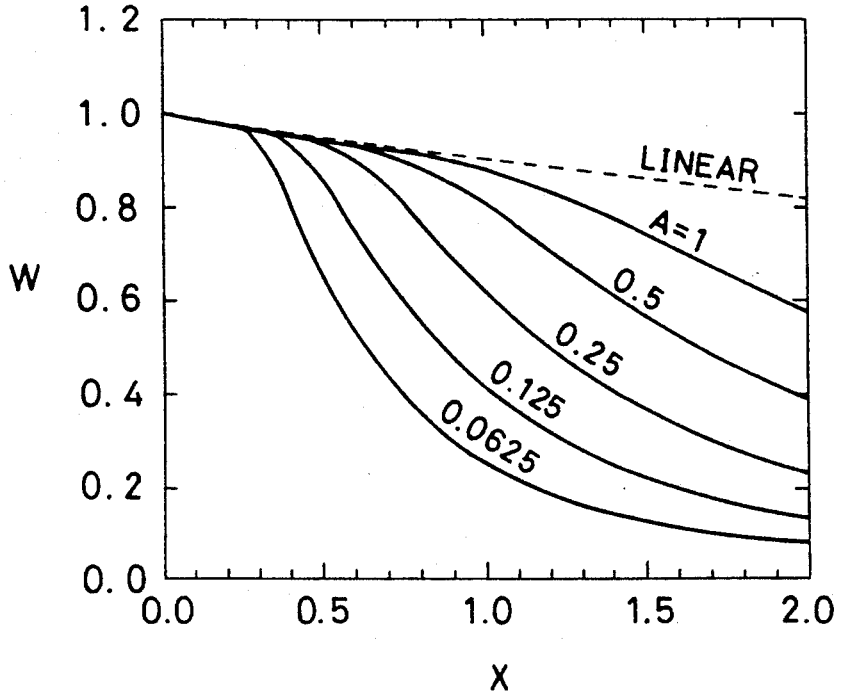
FIG. 3 shows curves based on results of theoretical calculations of the normalized time-averaged energy density (W) of ultrasonic waves with respect to the normalized propagation distance (X) of a plane sound wave in a fluid.

FIG. 3 shows examples of theoretical numerical calculations of the attenuation of the time-averaged energy density of ultrasonic waves of a plane sound wave in a fluid medium. The ordinate is a nondimensional time-averaged sound energy density W normalized by the value of the time-averaged sound energy at the transducer, and the abscissa is a nondimensional propagation distance X normalized by the shock formation distance for continuous waves in a lossless fluid.

As seen from these curves, for a constant time-averaged sound energy density at the transducer the amplitude has to be increased as the duty ratio A of the tone burst waves becomes smaller, to make up for the rest times. With the larger amplitude, the shock wave formation takes place closer to the transducer, bringing about extra nonlinear attenuation of the energy. Therefore, the driving force becomes stronger and more localized to the transducer as the duty ratio A of the tone burst waves becomes smaller. That is, with reference to FIG. 3, in the case of tone burst waves with a duty ratio 0.5, sound energy density starts a gradual attenuation from around a propagation distance X of 1.0, while in the case of tone burst waves with a duty ratio of 0.0625, energy density W attenuates sharply from around a propagation distance X of 0.4, so that the tone burst waves with a duty ratio of 0.0625 exerts a larger driving force on the fluid.

Figure 4:
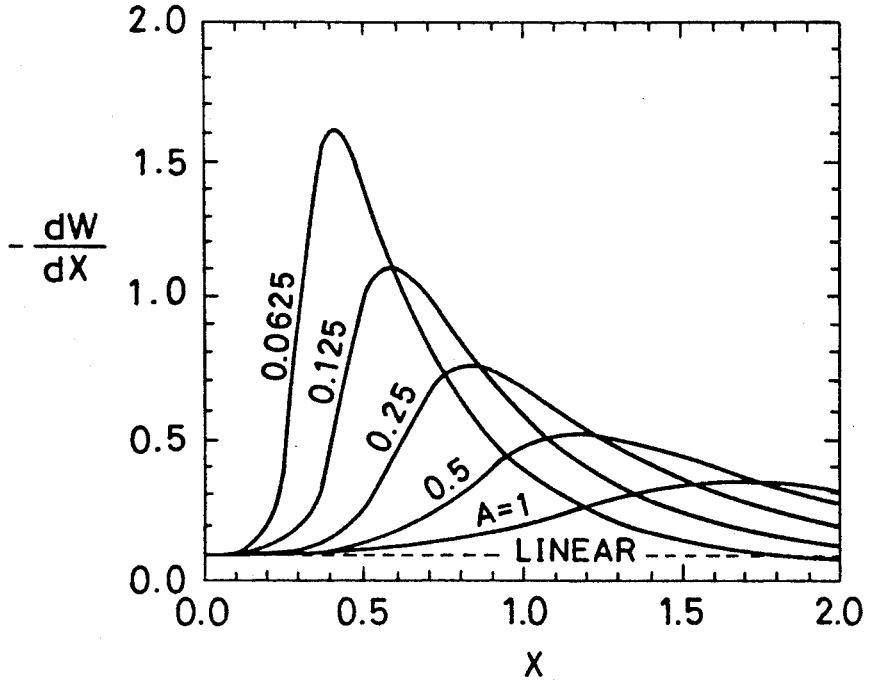
FIG. 4 shows spatial gradients (−(dW/dX)) of time-averaged sound energy density corresponding to the curves of FIG. 3.

FIG. 4 shows spatial gradients $-(dW/dX)$ of time-averaged sound energy density obtained by differentiating the time-averaged sound energy densities of FIG. 3 with respect to the normalized distance X. As seen from these curves, even when electrical signals are applied to produce the same time-averaged sound energy density at the transducer, smaller duty ratio A tone burst waves give rise to localized increases in the spatial gradient of the time-averaged sound energy density. Specifically, although the maximum gradient value of tone burst waves at a duty ratio of 0.5 is about 0.5 at a distance X value of 1.0, in the case of tone burst waves with a duty ratio of 0.0625, a maximum gradient value of about 1.6 is achieved at a distance X of about 0.4.

From FIG. 4, the point at which the ultrasonic wave-induced driving force acts on the fluid can be adjusted by adjusting the duty ratio of the tone burst waves and the corresponding amplitude, so that by selecting an appropriate duty ratio and amplitude it becomes possible to generate a driving force of a required intensity at a required distance from the transducer, to thereby form a beam-shaped flow current.

The fluid which is driven under control in accordance with this invention may be a gas as well as a liquid.

Figure 5:
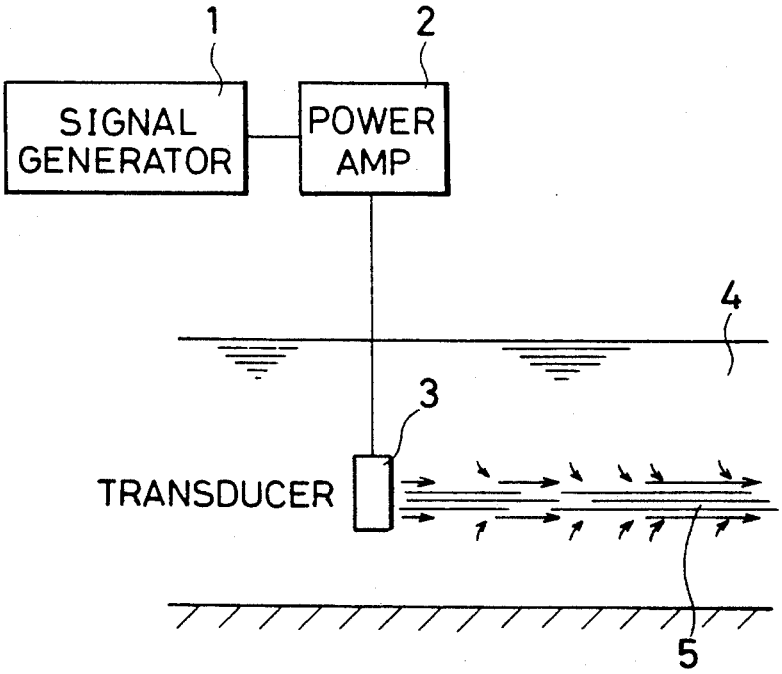
FIG. 5 is an explanatory view of an arrangement for implementing the fluid drive method according to the present invention.

FIG. 5 shows the basic arrangement of an embodiment for implementing the fluid drive method according to the present invention, comprising a signal generator 1 that is capable of generating electrical signals and varying the duty ratio, a power amplifier 2 for amplifying the electrical signals, and a transducer 3 placed in a liquid 4 for converting the amplified electrical signals to mechanical vibrations and transmitting ultrasound in the liquid.

With the above arrangement, the signal generator 1 generates electrical signals which are amplified by the amplifier 2, and these amplified electrical signals are converted to mechanical vibrations and transmitted as ultrasound by the transducer 3, thereby inducing an acoustic streaming flow 5. Tone burst waves are produced with a prescribed duty ratio and amplitude by regulating the electrical signals applied to the transducer 3 from the signal generator 1, thereby applying maximum driving force at a point a prescribed distance from the transducer 3 and forming a flow current. The driving force can, for example, be concentrated to induce a current in just one region of the liquid. By thus making it possible to stir a liquid within a confined container, it can be used to promote chemical reactions and improve heat transfer efficiency, for example. As the transducer is the only mechanical part of the apparatus, it forms a trouble-free, reliable method of driving a fluid.

What is claimed is:

1. A method of driving a fluid by transmitting ultrasound through the fluid, comprising the steps of:

applying electrical signals to a transducer disposed in the fluid to cause the transducer to emit tone burst waves in the fluid; and adjusting the electric signals to be applied so as to change the duty ratio and amplitude of the tone burst waves to be emitted, thereby controlling the intensity distribution of a streaming driving force acting on the fluid, such that effective use is made of ultrasonic energy by controlling of the intensity at at least one desired location, wherein the duty ratio is the ratio of the time in a burst cycle during which the transducer generates wave motion to the total time of a burst cycle.

2. A method of driving a fluid according to claim 1, wherein the electrical signals are adjusted to make the duty ratio of the tone burst waves small and the amplitude of the tone burst waves large, thereby shifting the intensity distribution of the streaming driving force to a position close to the transducer.

* * * * *